US006060219A

United States Patent [19]

Cathey

[11] Patent Number: 6,060,219

[45] Date of Patent: May 9, 2000

[54] METHODS OF FORMING ELECTRON EMITTERS, SURFACE CONDUCTION ELECTRON EMITTERS AND FIELD EMISSION DISPLAY ASSEMBLIES

[75] Inventor: David A. Cathey, Boise, Id.

[73] Assignee: Micron Technology, Inc., Boise, Id.

[21] Appl. No.: 09/083,329

[22] Filed: May 21, 1998

[51] Int. Cl.[7] ..... G03C 5/00

[52] U.S. Cl. ..... 430/311; 430/313

[58] Field of Search ..... 430/311, 313, 430/315, 320; 427/77; 313/346 R

[56] References Cited

U.S. PATENT DOCUMENTS

| | | | |
|---|---|---|---|
| 3,146,368 | 8/1964 | Fiore et al. . | |
| 3,406,068 | 10/1968 | Law | 96/36.1 |
| 3,485,658 | 12/1969 | Iler | 117/69 |
| 3,681,223 | 8/1972 | Gupton, Jr. | 204/181 |
| 4,407,695 | 10/1983 | Deckman et al. | 156/643 |
| 4,891,110 | 1/1990 | Libman et al. | 204/181.1 |
| 5,285,129 | 2/1994 | Takeda et al. | 313/346 |

(List continued on next page.)

FOREIGN PATENT DOCUMENTS

| | | |
|---|---|---|
| 769796 | 4/1997 | European Pat. Off. . |
| 7-65708 | 10/1995 | Japan . |

OTHER PUBLICATIONS

Finch, C.A., Polyvinyl Alcohol Developments, 1992 John Wiley & Sons, pp. 606–607.

Yamaguchi, E., et al, 6.2: A 10–in. Surface–Conduction Electron–Emitter Display, SID 97 Digest, pp. 52–55.

Shane, Michael et al, Electrophoretic Deposition of Phosphors, 1994, Academic Press, Inc. pp. 334–340.

Junge, Ch., et al., The Effect of Diazo and Chromate Sensitizers on the Accuracy and Adherence of Photodeposited Phosphor Lines in Color TV Tubes, 1979, Solid State Science and Technology, vol. 126, No. 7, pp. 1294–1298.

Takashi, H. et al (edited by Hawkes, P.), Advances in Electronics and Electron Physics, Academic Press, Inc., vol. 79, pp. 332–337.

Michaelson, H.B., Relation Between an Atomic Electronegativity Scale and the Work Function, IBM J. Res. Develop., vol. 22, No. 1, Jan., 1978, pp. 72–80.

Utsumi, T., Keynote Address—Vacuum Microelectronics: What's New and Exciting, IEEE Transactions on Electron Devices, vol. 38, No. 10, Oct. 1991, pp. 2276–2283.

Spindt, C.A., et al, Physical properties of thin–film field emission cathodes with molybdenum cones, Journal of Applied Physics, vol. 47, No. 12, Dec. 1976, pp. 5248–5263.

Ropp, R.C., 1993, The Chemistry of Artificial Lighting Devices, Studies in Inorganic Chemistry 17, pp. 530–537.

Chinnock, C., Electron–emission displays demonstrate potential, Laser Focus World, 1997, pp. 121–125.

Cathey, D., Jr., Field–Emission Displays Information Display, Oct. 1995, pp. 16–20.

Hara, Y, Cannon fires 60–in. FED at wall, Jan. 6, 1997, Electronic Engineering Times.

K~akai, I, et al, Flat Panel Displays Based on Surface–Conduction Electron Emitters, Euro Display '96, pp. 569–572.

Yamaguchi, K. Sakai, et al, A 10–in. Surface–Conduction Electron Emitter Display, Paper No. 199, pp. 1–6.

*Primary Examiner*—S. Rosasco

*Attorney, Agent, or Firm*—Wells, St. John, Roberts, Gregory & Matkin, P.S.

[57] ABSTRACT

A method of forming a surface conduction electron emitter is as follows. A first electrode and a second electrode are provided on a surface. The first and second electrodes are separated by a gap. A composition comprising particles and carrier material is provided over the surface. A portion of the composition that is over the surface is within the gap, and another portion of the composition that is over the surface is over the electrodes. The composition is exposed to a pattern of radiation to render the portion of the composition within the gap less soluble in a solvent than the portion of the composition that is over the electrodes. The composition is exposed to the solvent to remove an entirety of the portion of the composition that is over the electrodes while leaving the portion of the composition that is within the gap.

18 Claims, 2 Drawing Sheets

U.S. PATENT DOCUMENTS 5,372,973 12/1994 Doan et al. ..... 437/228
5,391,259 2/1995 Cathey et al. ..... 156/643
5,399,238 3/1995 Kumar ..... 156/643
5,576,051 11/1996 Takeda et al. ..... 427/77
5,824,604 10/1998 Bar-Gadda ..... 438/725
5,831,387 11/1998 Kaneko et al. ..... 313/495

METHODS OF FORMING ELECTRON EMITTERS, SURFACE CONDUCTION ELECTRON EMITTERS AND FIELD EMISSION DISPLAY ASSEMBLIES

PATENT RIGHTS STATEMENT

This invention was made with Government support under Contract No. DABT63-97-C-0001 awarded by Advanced Research Projects Agency (ARPA). The Government has certain rights in this invention.

TECHNICAL FIELD

The invention pertains to methods of forming electron emitters and field emission display assemblies, and particularly pertains to methods of forming and utilizing surface conduction electron emitters.

BACKGROUND OF THE INVENTION

Field effect display (FED) technology is presently being developed to replace the relatively bulky cathode ray tubes generally utilized in display devices. FED devices typically comprise a microtip structure comprising tiny conical electron emitters. The emitters are made as small as possible, and thousands of them are used to illuminate a single pixel.

A recently developed FED architecture is the so-called surface-conduction-electron (SCE) display. In an SCE display, electrons are emitted from a microfissure in a low work function material, such as diamond or palladium oxide (PdO). The SCE devices typically utilize one microfissure pattern per pixel. The microfissures, which may be only a few angstroms wide, emit electrons upon electrical stimulation.

The emitting structure of an SCE device comprises low work function materials formed within a gap between electrodes. The electrodes are typically adhered to an insulative emitter base, such as, for example, a glass plate. The low work function materials within the gap can be electrically stimulated by charging one or both of the electrodes.

A difficulty in forming SCE devices can be in providing the low work function materials between the electrodes. Presently, the low work function materials are provided by a printing process, wherein the low work function materials are printed into a gap between electrodes with an ink-jet printhead. The materials are then melted, either by heating or by exposure to a high current to form the microfissures within the materials. The above-described printing process requires specialized equipment and precise alignment of a printhead relative to an emitter base. It is desirable to develop other methods for precisely and accurately providing low work function materials within a gap between electrodes. Such other methods will preferably utilize existing equipment to improve the economics of incorporating the methods into fabrication processes.

SUMMARY OF THE INVENTION

In one aspect, the invention encompasses a method of forming an electron emitter. A composition comprising particles and carrier material is provided over a base. The base comprises emitter region locations and other locations. A portion of the composition is provided over the emitter region locations and another portion of the composition is provided over said other locations of the base. One of said portions of the composition is exposed to radiation while the other portion is left unexposed. After the exposure to radiation, the portion of the composition over the emitter region locations is less soluble in a solvent than said other portion of the composition. Said other portion is exposed to the solvent to selectively remove it from over the base.

In another aspect, the invention encompasses a method of forming a surface conduction electron emitter. A first electrode and a second electrode are provided on a surface such that the first and second electrodes are separated by a gap. A composition comprising particles and carrier material is formed and provided over the surface. A portion of the composition that is over the surface is within the gap, and another portion of the composition is not within the gap. The composition is exposed to a pattern of radiation to render the portion of the composition within the gap less soluble in a solvent than the portion that is not within the gap. The composition is then exposed to the solvent to remove the portion of the composition that is not within the gap.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
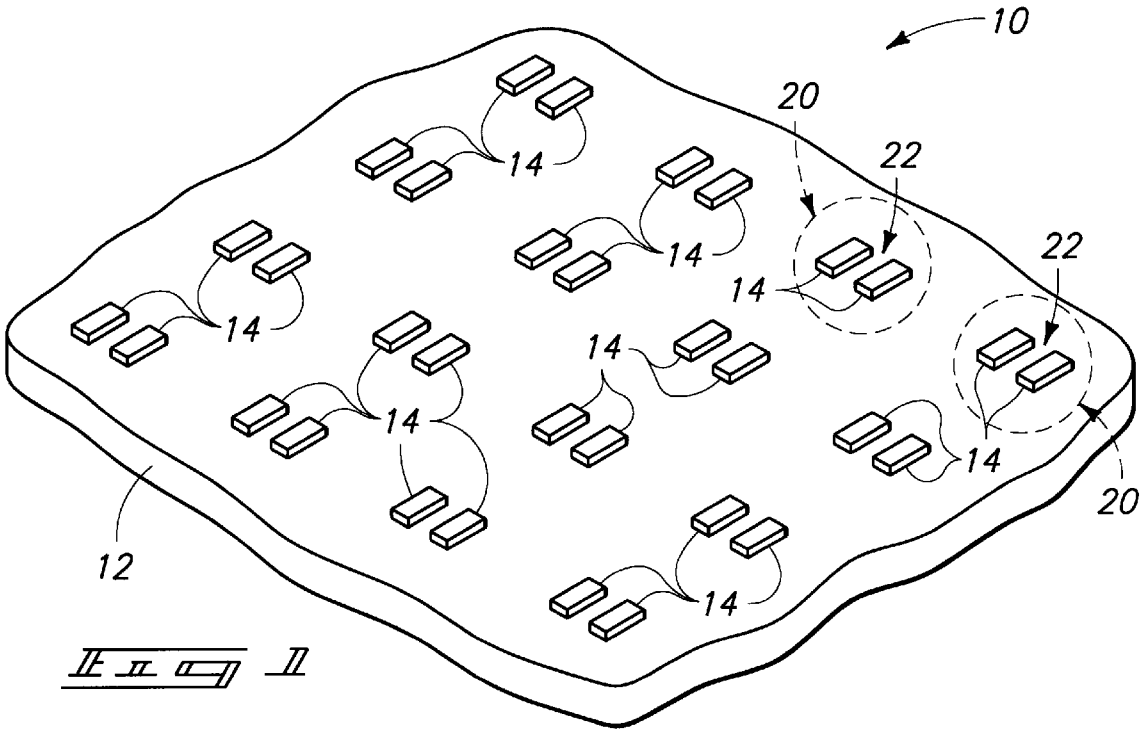
FIG. 1 is a fragmentary, isometric, diagrammatic view of an emitter base being processed according to a method of the present invention.

A method of forming an emitter base assembly in accordance with the present invention is described with reference to FIGS. 1–4. Referring to FIG. 1, an emitter base construction 10 is illustrated at a preliminary processing step. Construction 10 comprises an emitter base 12 having a plurality of electrodes 14 formed thereon. Electrodes 14 are provided in electrode pairs 20 (only two of which are labeled in FIG. 1). Electrode pairs 20 comprise two electrodes 14 separated by a gap 22. Gap 22 is preferably from several hundred angstroms to several millimeters in width.

Base 12 can comprise, for example, an insulating material such as glass or a ceramic. Electrodes 14 can be formed of conductive material, such as, for example, conductive oxide materials (such as $SnO_2$ or ITO), or metals (such as Au, Pt, or Ag). The electrodes preferably have a thickness of from several hundred angstroms to several microns. Electrodes 14 can be formed by, for example, photolithographic processing. In such processing, a mask can be provided over base 12 to cover most of the base, but to leave locations for formation of electrodes 14 exposed. The material of electrodes 14 is then deposited, and the mask removed. An example method of depositing a material of electrodes 14 is vacuum deposition of a metal.

Figure 2:
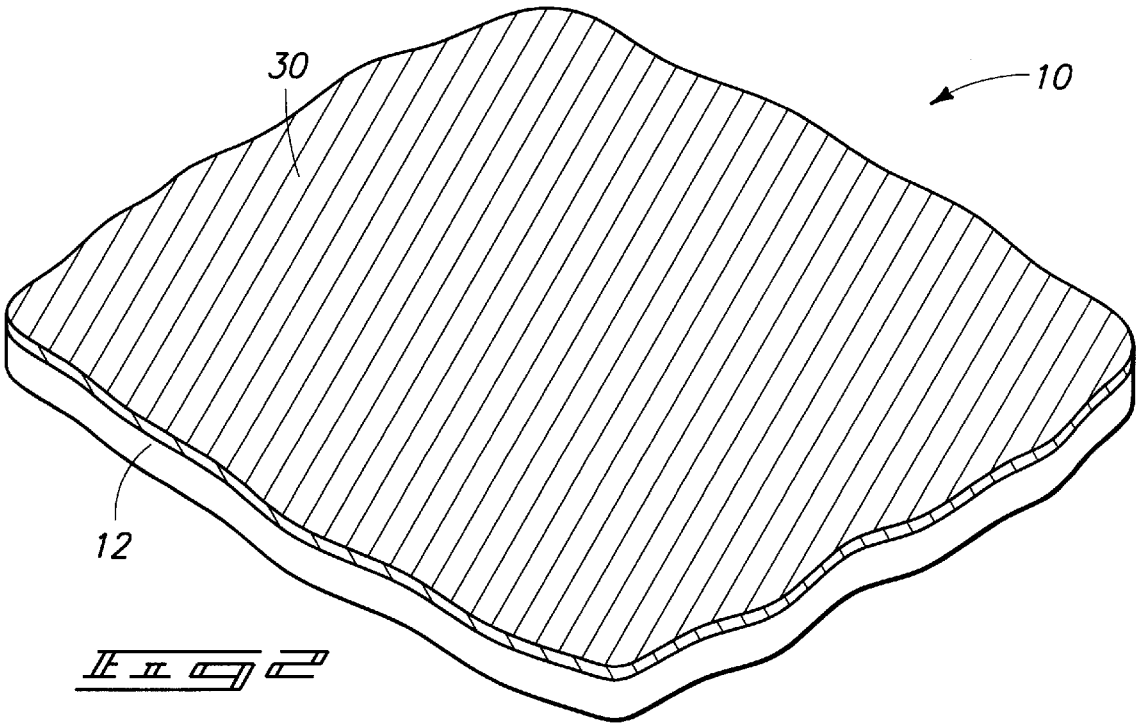
FIG. 2 is a view of the FIG. 1 emitter base shown at a processing step subsequent to that of FIG. 1.

Referring to FIG. 2, a composition 30 is provided over base 12. The composition is provided over gaps 22 (FIG. 1) as well as over other locations of base 12. Composition 30 comprises particles and carrier material. The particles preferably comprise low work function materials, such as, for example, PdO or diamonds. For purposes of interpreting this disclosure, a "low work function material" is defined as a material having a work function less than that of silicon. Several work functions are tabulated in an article by H. B. Michaelson, in IBM J. Res. Develop. Vol. 22, No. 1 (January 1978), pgs. 72–80. Silicon has a work function of about 4.5 electron volts. Accordingly, for purposes of interpreting this disclosure, a low work function material is a material having a work function of less than about 4.5 electron volts.

The carrier material of composition 30 can comprise, for example, a negative photoresist (such as, for example, polyvinyl alcohol), or a positive photoresist. Composition 30 is initially in the form of a slurry, and can be deposited over base 12 by, for example, a spin-on process. The deposition of composition 30 can include evaporation of solvents from the composition to form a substantially solid mass of composition 30 over base 12.

After deposition of composition 30, it is exposed to a pattern of radiation to render a portion of the composition within gaps 22 less soluble in a solvent than a portion of the composition that is not within gaps 22. Such exposure to a pattern of radiation can comprise photolithographic processing, wherein the pattern of radiation is generated by passing light through a photolithographic mask. The pattern of radiation will vary depending on whether the material of composition 30 constitutes a positive photoresist or a negative photoresist. If the material of composition 30 comprises a negative photoresist, then portions of composition 30 within gaps 22 will be exposed to radiation, while portions in other locations will not be exposed to the radiation. On the other hand, if composition 30 comprises a positive photoresist, then portions of composition 30 within gaps 22 will not be exposed to radiation and other portions of composition 30 will.

After the exposure of composition 30 to the pattern of radiation, the composition is exposed to a solvent which selectively removes the portion of the composition that is not within gaps 22. For instance, if composition 30 comprises polyvinyl alcohol, (a negative photoresist), the portion of composition 30 within gaps 22 is exposed to ultraviolet light, while the remaining portions of composition 30 are not exposed to such light. The portions not exposed to ultraviolet light remain water soluble, and the portions exposed to ultraviolet light polymerize to become water insoluble. Composition 30 is then exposed to water to remove the portions of composition 30 which are not within gaps 22.

Figure 3:
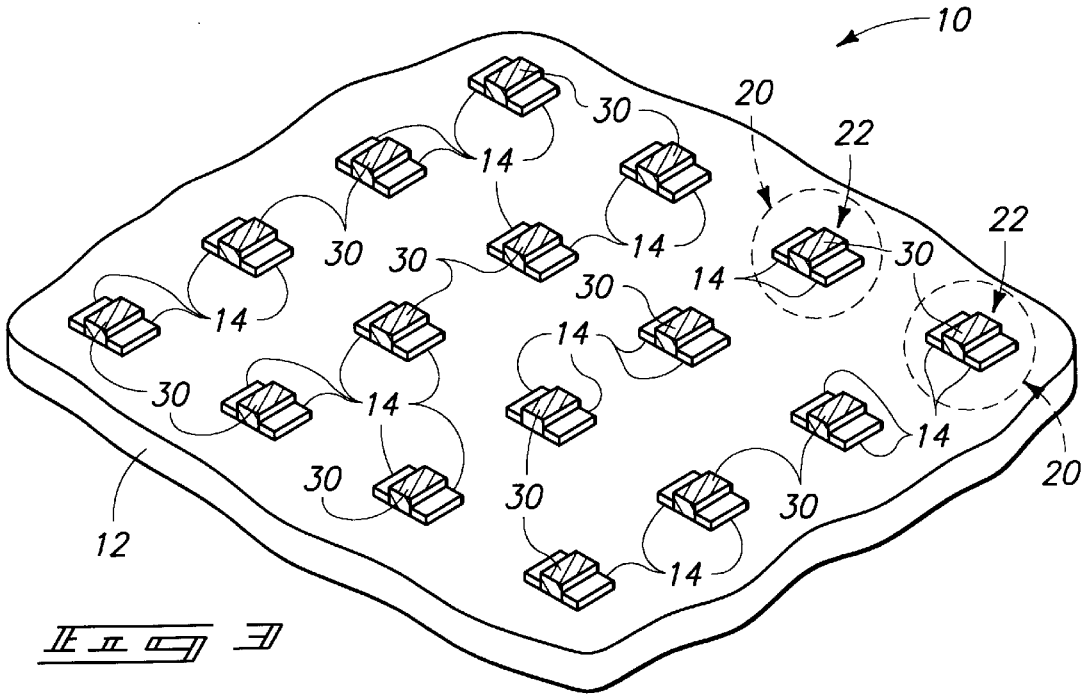
FIG. 3 is a view of the FIG. 1 emitter base shown at a processing step subsequent to that of FIG. 2.

FIG. 3 illustrates emitter base construction 10 after removal of the portions of composition 30 that were not within gaps 22. The portions of composition 30 remaining within gaps 22 can be furthered processed to remove the photoresist from the composition. For instance, composition 30 can be exposed to a hydrogen-comprising plasma to gasify the photoresist from the composition. Also, the low work function particles remaining within gaps 22 can be further processed to form microfissures within the particles. Such further processing can include the heating or high current processing discussed above in the "Background" section of this disclosure.

The paired electrodes 22 and low work function material between them together comprise surface conduction electron emitters. In contrast to the prior art methods of forming surface conduction electron emitters, the present invention method utilizes photolithographic processing to precisely align the low work function particles within gaps 22 between paired electrodes. Photolithographic processing is a method already used for other applications in field emission display fabrication. Accordingly, the present invention can enable surface conduction emitter technology to be economically integrated within existing field effect display fabrication processes.

After provision of the low work function particles within gaps 22, base emitter construction 10 can be incorporated into a field effect display apparatus. The shown plurality of electrodes 14 form a square matrix over base 12. A plurality of connecting wires can be formed to connect individual electrodes of the matrix. Specifically, individual connecting wires can be formed to extend along either rows or columns to electrically connect electrodes lying along said rows or columns.

Figure 4:
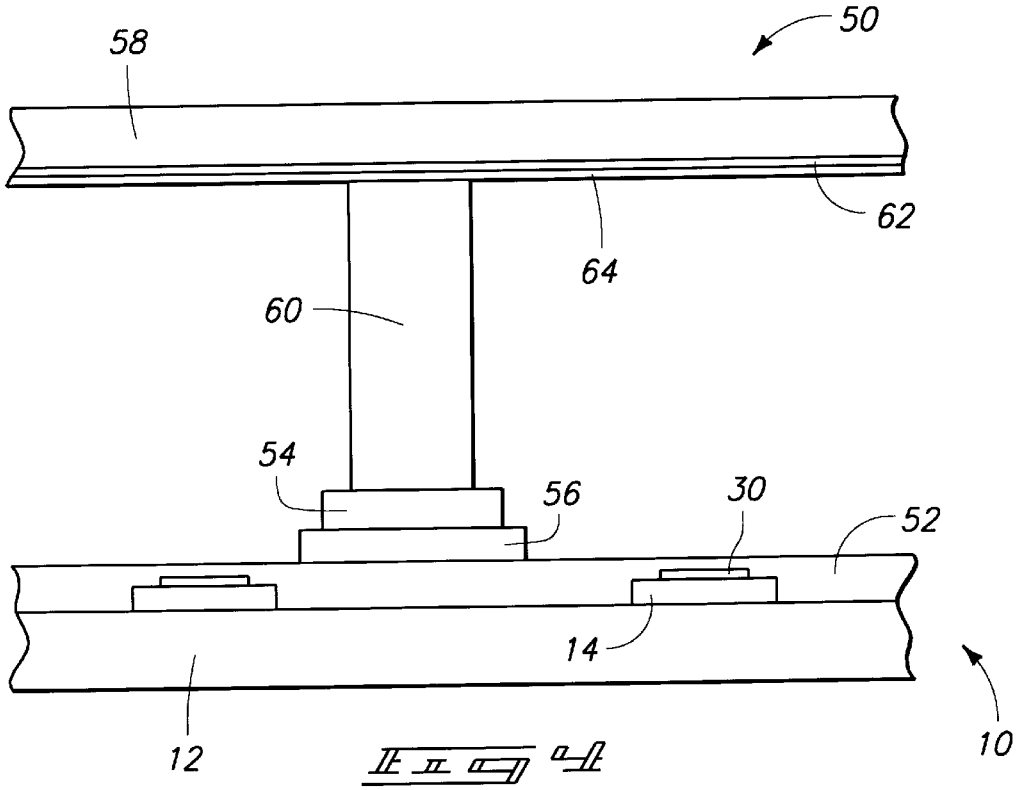
FIG. 4 is a fragmentary, diagrammatic, cross-sectional sideview of a field emission display assembly comprising an emitter base of the present invention.

Referring to FIG. 4, a cross-sectional sideview of a field emission display assembly 50 comprising base emitter construction 10 is illustrated. Assembly 50 comprises connecting wires 52 and 54 extending over base plate 12. Wire 54 extends perpendicularly to wire 52 and is separated from wire 52 by an insulator 56. A face plate 58 is provided above base plate 12, and supported over base plate 12 by a spacer 60. Face plate 58 is coated with a layer of phosphor 62, which is in turn covered by a metal backing 64. Metal backing 64 can comprise, for example, aluminum. A vacuum is preferably provided between face plate 58 and base plate 12, and the assembly 50 sealed to maintain such vacuum between the plates. In operation, an electrical input is provided to electrodes 14 through one or both of connecting wires 52 and 54 to cause a discharge through the low work function particles in gap 22 (FIG. 3). The low work function particles then discharge electrons toward phosphor layer 62, resulting in the lighting of a pixel.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of forming a surface conduction electron emitter comprising:

providing a first electrode and a second electrode on a surface, the first and second electrodes being separated by a gap;

providing a composition comprising particles and carrier material over the surface, a portion of the composition that is over the surface being within the gap, and another portion of the composition that is over the surface being over the electrodes;

exposing the composition that is over the surface to a pattern of radiation to render the portion of the composition within the gap less soluble in a solvent than the portion of the composition that is over the electrodes; and after exposing the composition to the radiation, exposing the composition that is over the surface to the solvent to remove an entirety of the portion of the composition that is over the electrodes while leaving the portion of the composition that is within the gap.

2. The method of claim 1 wherein the electrode and the portion of the composition within the gap comprise an emitter construction, the method further comprising incorporating the emitter construction into a display device.

3. The method of claim 1 wherein the electrode and the portion of the composition within the gap comprise an emitter construction, the method further comprising:

incorporating the emitter construction into a display device, the display device comprising a phosphor coated face plate; and configuring the emitter construction to emit electrons toward phosphors on the phosphor-coated face plate in response to electrical input to the emitter construction.

4. The method of claim 1 wherein the carrier material comprises polyvinyl alcohol.

5. The method of claim 1 wherein the carrier material comprises polyvinyl alcohol and the solvent comprises water.

6. The method of claim 1 wherein the carrier material is a positive photoresist.

7. The method of claim 1 wherein the carrier material is a negative photoresist.

8. The method of claim 1 wherein the particles comprise materials selected from the group consisting of diamond and PdO.

9. The method of claim 1 further comprising, after the exposing, removing the carrier material from the portion of the composition within the gap while leaving the particles within the gap.

10. The method of claim 9 wherein the removing comprises gasification of the carrier material with a hydrogen-comprising plasma.

11. A method of forming a field emission display assembly, comprising:

providing a base;

forming a plurality of electrodes on said base, the plurality of electrodes comprising electrode pairs, the electrode pairs comprising two electrodes separated by a gap;

forming a composition comprising particles and carrier material, and depositing the composition over the base, a portion of the composition being deposited within the gaps, and a portion of the composition being deposited over the electrodes;

exposing the deposited composition to a pattern of radiation to render the portion of the composition within the gaps less soluble in a solvent than the portion of the composition that is over the electrodes;

after exposing the deposited composition to the radiation, exposing the deposited composition to the solvent to remove an entirety of the portion of the composition that is over the electrodes;

forming a plurality of connecting wires to electrically connect the electrodes to electrical input signals;

providing a spacer extending upwardly from the base; and providing a phosphor coated face plate supported by the spacer.

12. The method of claim 11 wherein the plurality of electrodes are arranged in a matrix over the base, and wherein the connecting wires extend along rows and columns of the matrix, the individual connecting wires extending along either rows or columns to electrically connect electrodes lying along said rows or columns.

13. The method of claim 11 further comprising:

providing a vacuum between the phosphor coated face plate and the base; and after providing the vacuum, sealing the assembly to maintain the vacuum.

14. The method of claim 11 wherein the particles comprise materials selected from the group consisting of diamond and PdO.

15. The method of claim 11 wherein the carrier material is a positive photoresist.

16. The method of claim 11 wherein the carrier material is a negative photoresist.

17. The method of claim 11 further comprising, after the exposing, removing the carrier material from the portion of the composition within the gap while leaving the particles within the gap.

18. The method of claim 17 wherein the removing comprises gasification of the carrier material with a hydrogen-comprising plasma.

* * * * *